US011358410B2

(12) United States Patent
Mwamlima

(10) Patent No.: US 11,358,410 B2
(45) Date of Patent: Jun. 14, 2022

(54) ARTWORK MAGNETIC HOOK AND LOOP BACKDROP

(71) Applicant: Western Mwamlima, Norfolk, VA (US)

(72) Inventor: Western Mwamlima, Norfolk, VA (US)

( * ) Notice: Subject to any disclaimer, the term of this patent is extended or adjusted under 35 U.S.C. 154(b) by 0 days.

(21) Appl. No.: 16/941,879

(22) Filed: Jul. 29, 2020

(65) Prior Publication Data

US 2021/0053387 A1 Feb. 25, 2021

Related U.S. Application Data

(60) Provisional application No. 62/890,968, filed on Aug. 23, 2019.

(51) Int. Cl.

| | |
|---|---|
| ***B44D 3/00*** | (2006.01) |
| ***F21V 33/00*** | (2006.01) |
| ***G09F 15/00*** | (2006.01) |
| ***F21Y 115/10*** | (2016.01) |

(52) U.S. Cl.

CPC ..... *B44D 3/00* (2013.01); *F21V 33/0028* (2013.01); *G09F 15/0062* (2013.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 4,471,548 A * | 9/1984 | Goudie | E04H 12/182 40/610 |
| 6,836,988 B2 * | 1/2005 | Zarelius | G09F 15/00 40/600 |
| 8,783,328 B2 * | 7/2014 | Melhart | G10K 11/20 160/32 |
| 9,551,921 B2 * | 1/2017 | Redmon | G09F 1/12 |

(Continued)

FOREIGN PATENT DOCUMENTS

EP 2333754 A1 * 6/2011 ..... G09F 15/0062

OTHER PUBLICATIONS

"Ultra-Mag Flexible magnetic sheeting" https://www.arnoldmagnetics.com/wp-content/uploads/2017/10/UltraMag-Sheet-and-Strip.pdf (Year: 2017).*

*Primary Examiner* — Britt D Hanley

(74) *Attorney, Agent, or Firm* — Lyman Moulton, Esq.; Moulton Patents, PLLC

(57) ABSTRACT

An artistic magnetic or hook and loop backdrop is disclosed which hangs over an artist's easel for display which makes it easier to cleanup! It works differently than other products on the market because it is a light matted-art magnetic display, as opposed to a heavier cloth canvas. Additionally, this product allows for two interior LED strip lights to be placed on the backdrop so that the display tent can be illuminated without the use of bulky lighting. The artist does not need to stack the canvas in bins or boxes with the Artwork Magnetic Backdrop and can instead roll the backdrop up for easy portability. Ideally, there will be small (Continued)

pockets in the backdrop to store magnets so that the artist can easily access them before hanging new projects. Additionally, this product has been used to hang light weight 8×10", 11×14", and 20×24" artwork through windy outdoor shows.

15 Claims, 6 Drawing Sheets

(56) References Cited

U.S. PATENT DOCUMENTS

| | | | | |
|---|---|---|---|---|
| 2006/0162202 | A1* | 7/2006 | Landry | G09F 1/08 40/541 |
| 2007/0006498 | A1* | 1/2007 | Collins | G09F 15/0025 40/610 |
| 2020/0113301 | A1* | 4/2020 | Nolan Krouse | A45C 7/0077 |

* cited by examiner

ARTWORK MAGNETIC HOOK AND LOOP BACKDROP

CROSS REFERENCE TO RELATED APPLICATIONS

The present non-provisional patent application claims priority to the Provisional application 62/890,968 filed Aug. 23, 2019 by Western Mwamlima for an "Artwork Magnetic Hook and Loop Backdrop," which is included in its entirety in the present application.

BACKGROUND OF THE INVENTION

The main purpose of an artwork backdrop is to allow artists the flexibility of travel during their art shows. Traditionally, the mesh displays do not allow for the artist to hang all their displays as easily or as quickly as they would like and can make the presentation process a headache. The packaging of most canvases is also bulky and uncomfortable to carry, making for a more complicated unraveling process before setting up and presenting to the audience.

SUMMARY OF THE DISCLOSURE

An artistic magnetic backdrop is disclosed which hangs over an artist's easel for display which makes it easier to cleanup! It works differently than other products on the market because it is a light matted-art magnetic display, as opposed to a heavier cloth canvas. Optionally, the backdrop includes hook and loop like complementary surfaces for fixing artwork on the cloth or canvas. Additionally, this product allows for two interior LED strip lights to be placed on the backdrop so that the display tent can be illuminated without the use of bulky lighting.

The artist does not need to stack the canvas in bins or boxes with the Artwork Magnetic Backdrop and can instead roll the backdrop up for easy portability. Ideally, there will be small pockets in the backdrop to store magnets so that the artist can easily access them before hanging new projects. Additionally, this product has been used to hang light weight 8×10", 11×14", and 20×24" artwork through windy outdoor shows. Having a portable and versatile product to use during art shows can solve many problems in the art industry.

Horizontal or hook and loop magnetic strips are mounted on a mobile base with wheels in accordance with an embodiment of the present invention. Embodiments include the display cloth, a collapsible structure, a mobile base with wheels C and pockets for display pockets D. The pockets include magnetic material to fix a display in a predetermined place on the cloth backdrop. The embodiment also includes horizontal magnetic strips in broken lines embedded in a rear side of the cloth A or disposed thereon.

Figure 1:
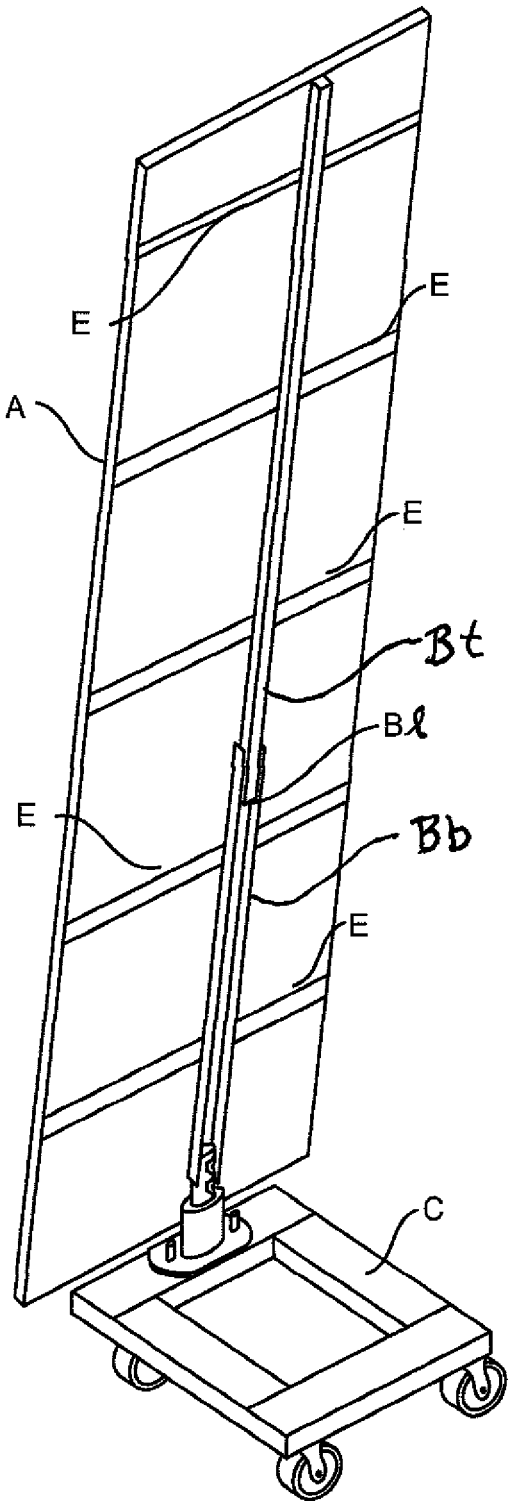
FIG. 1 depicts a rear side of an artwork magnetic backdrop with horizontal magnetic strips mounted on a mobile base with wheels in accordance with an embodiment of the present invention.

Throughout the description, similar reference numbers may be used to identify similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

Throughout the present disclosure the term 'scrollable grid' refers to a grid able to be rolled The term 'magnetic' is used in the common sense to refer to a material which responds to magnetism such as metal and magnets themselves including low durometer magnets and less tensile metallic strips. The term 'hook and loop,' refers to complementary surfaces for adhering artwork to the cloth or canvas similar to Velcro®.

In an embodiment of the disclosure, an inventor can unroll the magnetic backdrop and hang it over their easel for display which makes it easier to cleanup! It works differently than other products on the market because it is a light matted-art magnetic display, as opposed to a heavier cloth canvas. Additionally, this product allows for two interior LED strip lights to be placed on the backdrop so that the display tent can be illuminated without the use of bulky lighting.

The artist does not need to stack the canvas in bins or boxes with the Artwork Magnetic Backdrop and can instead roll the backdrop up for easy portability. Ideally, there will be small pockets in the backdrop to store magnets so that the artist can easily access them before hanging new projects. Additionally, this product has been used to hang light weight 8×10", 11×14", and 20×24" artwork through windy outdoor shows. Having a portable and versatile product to use during art shows can solve many problems in the art industry.

FIG. 1 depicts a rear side of an artwork magnetic backdrop with horizontal magnetic strips mounted on a mobile base with wheels in accordance with an embodiment of the present invention. The depiction includes the display cloth A, a collapsible and locking rod having parts Bb, Bt and locking part Bl, a mobile base with wheels C and pockets for display pockets D (not shown). The depiction also includes horizontal magnetic or hook and loop strips E in broken lines embedded in a rear side of the cloth A or disposed thereon.

Figure 2:
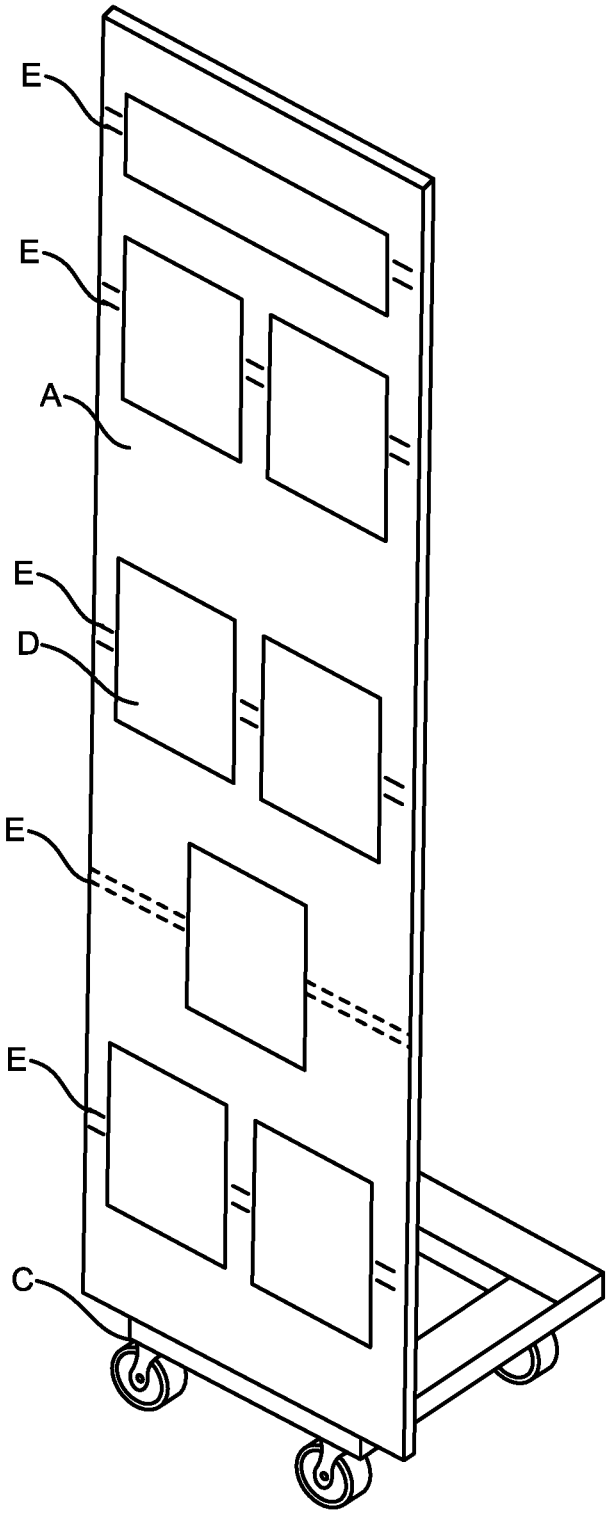
FIG. 2 depicts the front side of an artwork magnetic backdrop with horizontal magnetic strips mounted on a mobile base with wheels in accordance with an embodiment of the present invention.

FIG. 2 depicts the front side of an artwork magnetic backdrop with horizontal magnetic strips mounted on a mobile base with wheels in accordance with an embodiment of the present invention. The depiction includes the display cloth A, a mobile base with wheels C and pockets for display pockets D. The depiction also includes horizontal magnetic or hook and loop strips E embedded in the cloth A or disposed thereon.

Figure 3:
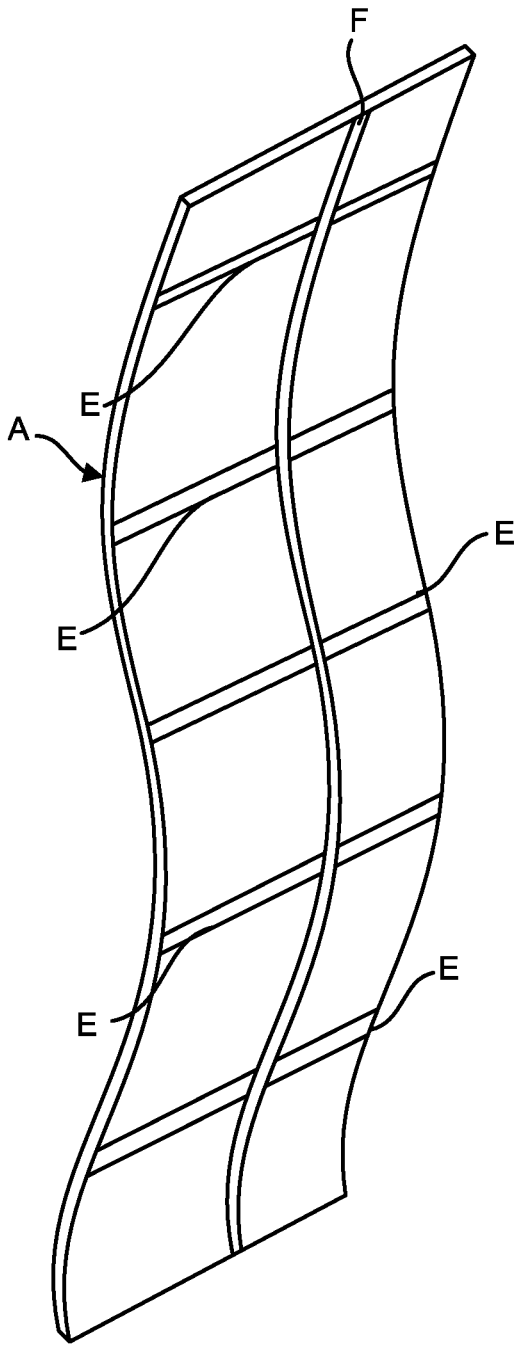
FIG. 3 depicts an unsupported artwork canvas panel magnetic backdrop with horizontal magnetic strips and one vertical magnetic strip in accordance with an embodiment of the present disclosure.

FIG. 3 depicts an unsupported artwork canvas panel magnetic backdrop with horizontal magnetic strips and one vertical magnetic strip in accordance with an embodiment of the present disclosure. The depiction includes the display cloth A and pockets for display pockets D (not shown). The depiction also includes horizontal magnetic strips E and one flexible magnetic strip F embedded in the cloth A or disposed thereon.

Figure 4:
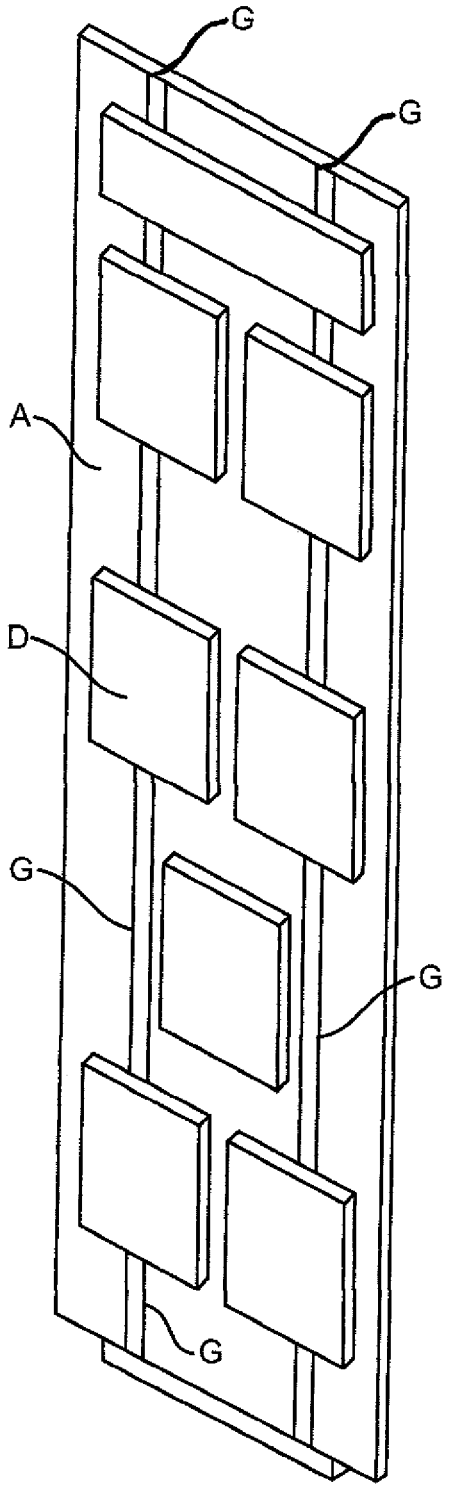
FIG. 4 depicts a front side of a supported artwork panel magnetic backdrop with two light strips in accordance with an embodiment of the present disclosure.

FIG. 4 depicts a front side of a supported artwork panel magnetic backdrop with two light strips in accordance with an embodiment of the present disclosure. The depiction includes the display cloth A and pockets for display pockets D and the light strips G implemented LED in embodiments. The depiction also includes horizontal magnetic or hook and loop strips E and one flexible magnetic strip F (not shown) embedded in the cloth A or disposed thereon.

Figure 5:
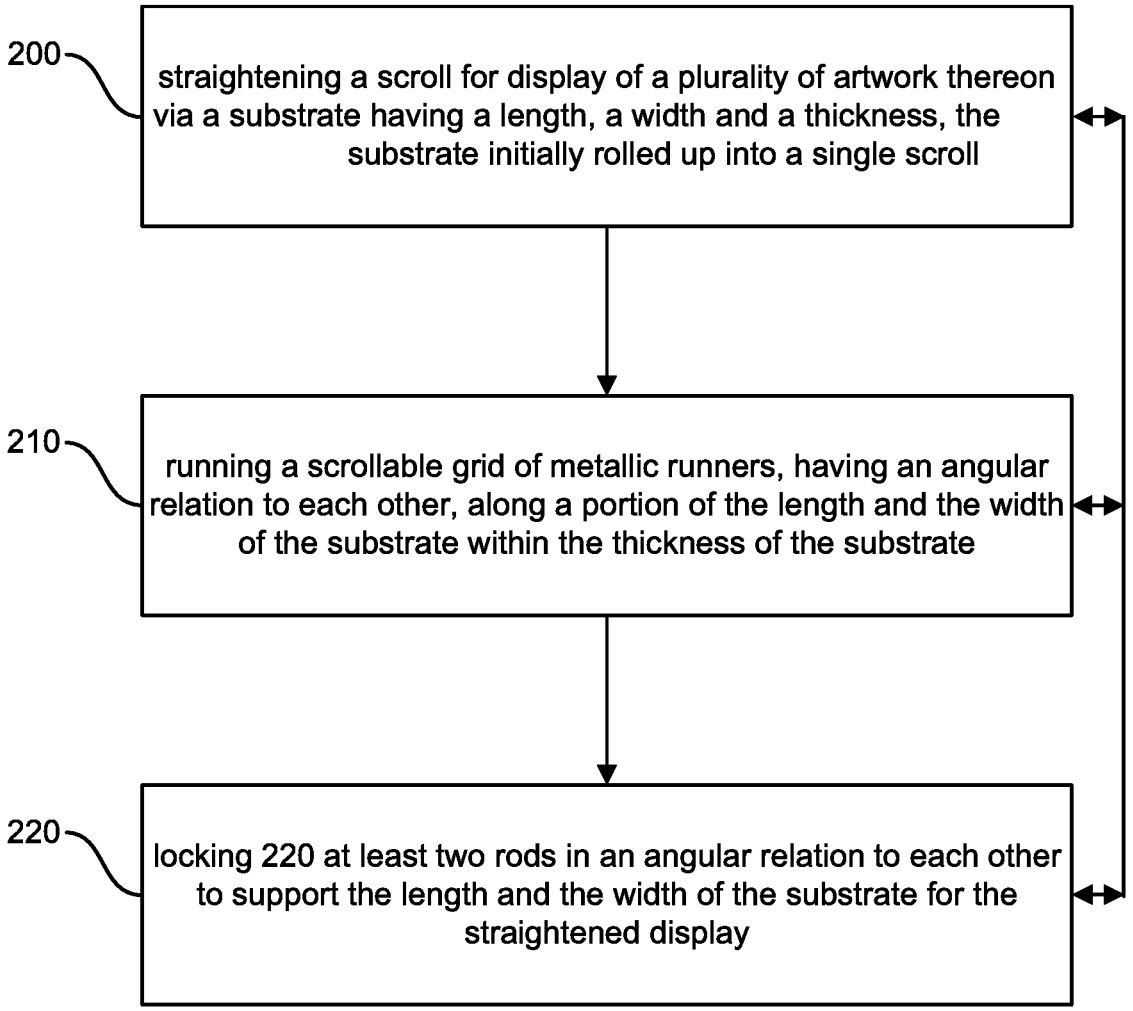
FIG. 5 depicts a flow chart of a method of displaying artwork in accordance with an embodiment of the present disclosure.

FIG. 5 depicts a flow chart of a method of displaying artwork in accordance with an embodiment of the present disclosure. The method includes straightening 200 a scroll for display of a plurality of artwork thereon via a substrate having a length, a width and a thickness, the substrate initially rolled up into a single scroll. The method also includes running 210 a scrollable grid of metallic runners, having an angular relation to each other, along a portion of the length and a portion of the width of the substrate within the thickness of the substrate. The method also includes locking 220 at least two rods in an angular relation to each other to support the length and the width of the substrate for the straightened display.

Figure 6:
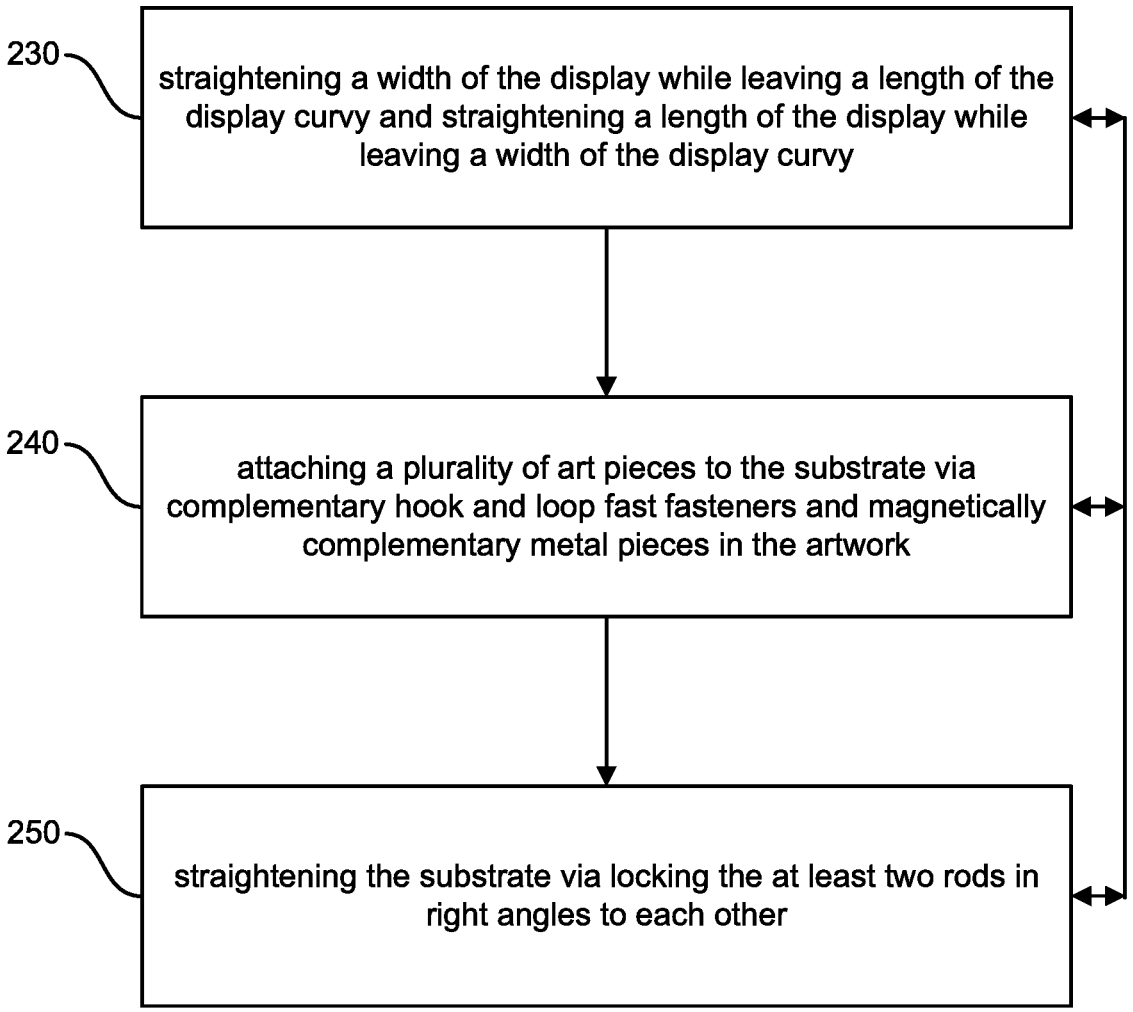
FIG. 6 depicts a flow chart of additional methods of displaying artwork in accordance with an embodiment of the present disclosure.

FIG. 6 depicts a flow chart of additional methods of displaying artwork in accordance with an embodiment of the present disclosure. An embodiment of the method includes scrolling the substrate along a long edge of the substrate and along a short edge of the substrate. Another embodiment comprises straightening 230 a width of the display while leaving a length of the display curvy and straightening a length of the display while leaving a width of the display curvy. Other embodiments of the method comprise attaching a plurality of art pieces to the substrate via complementary hook and loop fast fasteners and magnetically complementary metal pieces in the artwork. Embodiments yet include attaching 240 a plurality of art pieces to the substrate via a plurality of width running runners within the thickness of the substrate and a plurality of length running runners within the thickness of the substrate. The method additionally comprises straightening 250 the substrate via locking the at least two rods in right angles to each other.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

While the forgoing examples are illustrative of the principles of the present disclosure in one or more particular applications, it will be apparent to those of ordinary skill in the art that numerous modifications in form, usage and details of implementation can be made without the exercise of inventive faculty, and without departing from the principles and concepts of the invention.

The instant invention has been shown and described in what it considers to be the most practical and preferred embodiments. It is recognized, however, that departures may be made there from within the scope of the invention and that obvious modifications will occur to a person skilled in the art.

What is claimed is:

1. A display device, comprising:

a. a substrate having a length, a width and a thickness, the substrate initially rolled up into a single scroll and straightened for display;

b. a scrollable grid of metallic runners having an angular relation to each other and flexible along a portion of the length and a portion of the width of the substrate and embedded in the thickness of the substrate; and c. at least two collapsible and locking rods in an angular relation to the scrollable grid configured to support the length and the width of the substrate for the straightened display.

2. The display device of claim 1, further comprising a hook and loop attachment for artwork to the substrate at random locations on the substrate.

3. The display device of claim 1, wherein the scrollable grid of metallic runners are magnetically complementary to magnets and metal on artwork pieces for display on the display device.

4. The display device of claim 1, further comprising at least one LED (light emitting diode) light strip disposed on the substrate configured to illuminate artwork fixed on the substrate.

5. The display device of claim 1, further comprising a mobile base with wheels, the base configured to give an erect gravitational stasis to the at least two locking rods for display.

6. The display device of claim 1, wherein the scrollable grid of metallic runners comprise low durometer magnetic strips.

7. The display device of claim 1, further comprising a mobile base with wheels and a mount for the at least two locking rods.

8. The display device of claim 1, wherein the collapsible and locking rod also locks in a parallel relation to the scrollable grid.

9. The display device of claim 1, wherein the collapsible and locking rod also locks in an orthogonal relation to the scrollable grid.

10. The display device of claim 1, wherein the scrollable grid of metallic runners are disposed at right angles to each other.

11. The display device of claim 1, wherein the collapsible and locking rod is configured to support the length portion and the width portion of the substrate for a straightened display portion.

12. The display device of claim 1, wherein the substrate is rolled up into a single scroll along a long edge of the substrate.

13. The display device of claim 1, wherein the substrate is rolled up into a single scroll along a short edge of the substrate.

14. The display device of claim 1, wherein the substrate is straightened along a width of the display via the collapsible and locking rod while leaving a length of the display curvy.

15. The display device of claim 1, wherein the substrate is straightened along a length of the display via the collapsible and locking rod while leaving a width of the display curvy.

* * * * *